United States Patent [19]

Lindsay

[11] 4,118,059

[45] Oct. 3, 1978

[54] WIRE ROPE SLINGS

[75] Inventor: William Roy Mackintosh Lindsay, Lenzie, Scotland

[73] Assignee: Gyrac Engineering Products Limited, Glasgow, Scotland

[21] Appl. No.: 828,967

[22] Filed: Aug. 29, 1977

[51] Int. Cl.[2] ..... B66C 1/12

[52] U.S. Cl. ..... 294/74; 24/115 R; 294/78 R

[58] Field of Search ..... 294/78 R, 74, 75, 76; 24/122.6, 122.3, 115 R

[56] References Cited

U.S. PATENT DOCUMENTS

| | | | |
|---|---|---|---|
| 2,080,148 | 5/1937 | Naysmith | 294/74 |
| 2,946,619 | 7/1960 | Wahl | 294/74 |
| 3,289,259 | 12/1966 | Laharty | 294/74 |

FOREIGN PATENT DOCUMENTS

| | | | |
|---|---|---|---|
| 2,363,736 | 6/1975 | Fed. Rep. of Germany | 294/78 P |

*Primary Examiner*—James B. Marbert

*Attorney, Agent, or Firm*—Mason, Fenwick & Lawrence

[57] ABSTRACT

The storage of pipes hoisted by means of a wire-rope sling tightly noosed around the pipes to form a pipe bundle is facilitated by clamping the rope in the sleeve of the sling choker to lock the tight noose against loosening when the pipe bundle is deposited on a support and is connected from the hoisting means. The sleeve bore is of generally keyhole section. The rope is a sliding fit in the part-cylindrical portion of the bore so as to be locked in said portion and project laterally into the adjacent channel portion of the bore. By force-fitting a pin into the channel portion in which the pin is a sliding fit, the rope length in the bore is clamped against the part-cylindrical portion of the bore.

7 Claims, 9 Drawing Figures

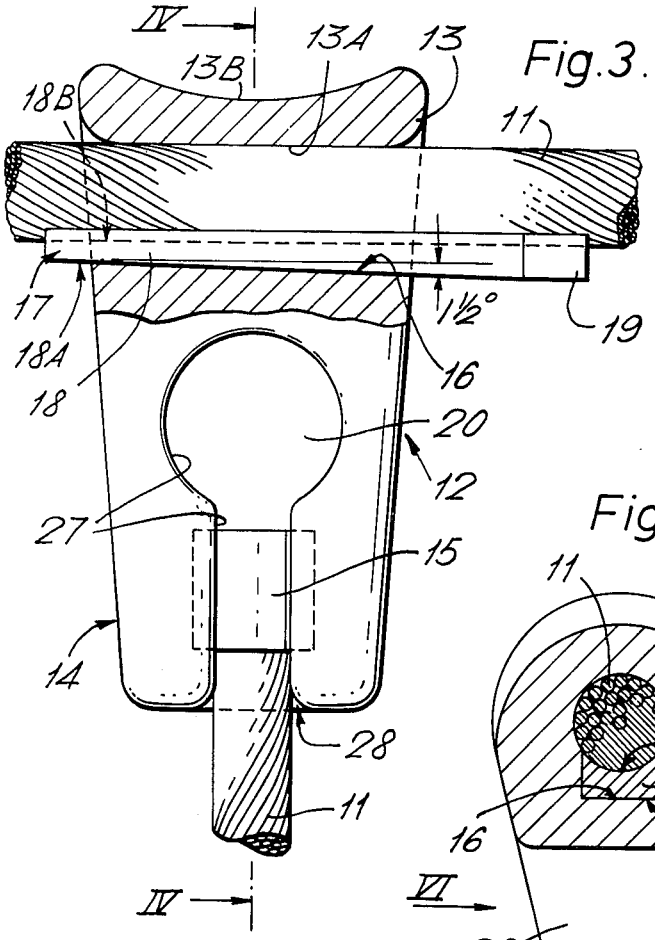
Fig.3.
Fig.4.
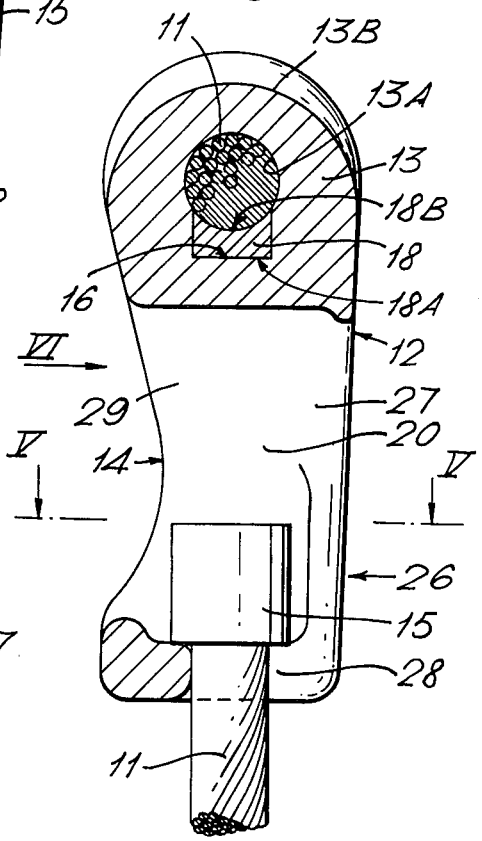
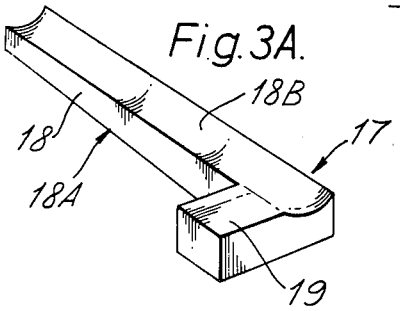
Fig.3A.

WIRE ROPE SLINGS

This invention relates to improvements in wire-rope slings for use in lifting loads.

The present invention is particularly concerned with a wire-rope sling for use in lifting loads, comprising a choker device which has an eye portion through which the rope is runningly threaded and has a first coupling formation adjacent to the eye portion, a second coupling formation on the rope at one end thereof and detachably engagable with the first coupling formation to form a tightenable noose of rope around the load, and clamping means engageable with the rope portion in the eye portion to secure the rope portion to the eye portion and thereby prevent slackening of the tightened noose of rope engaging the load.

According to the present invention I provide a sling for use in lifting loads, comprising a wire rope, a choker having a sleeve through which the rope extends and having a first coupling formation adjacent to the sleeve, a second coupling formation on the rope at one end thereof and detachably engageable with the first coupling formation of the choker to form a tightenable noose of rope around the load, said sleeve having a generally keyhole-section bore whereof the wall is composed of a part-cylindrical portion in which the rope is a sliding fit so as to be locked against lateral displacement and a channel portion which opens from the part-cylindrical portion and into which a length of the rope projects laterally, and a pin which is sliding fit in the channel portion and is insertible into the channel portion to clamp said length of the rope against the part-clyindrical portion of the bore wall and thereby prevent slackening of the noose tightened around the load.

Embodiments of the invention will now be described by way of example with reference to the accompanying drawings in which:

FIG. 3 is an enlarged part-sectional front view of the choker device shown in FIG. 1;

FIG. 3A is a top perspective view of the pin;

FIG. 4 is a sectional end view on the line IV—IV of FIG. 3;

Figure 1:
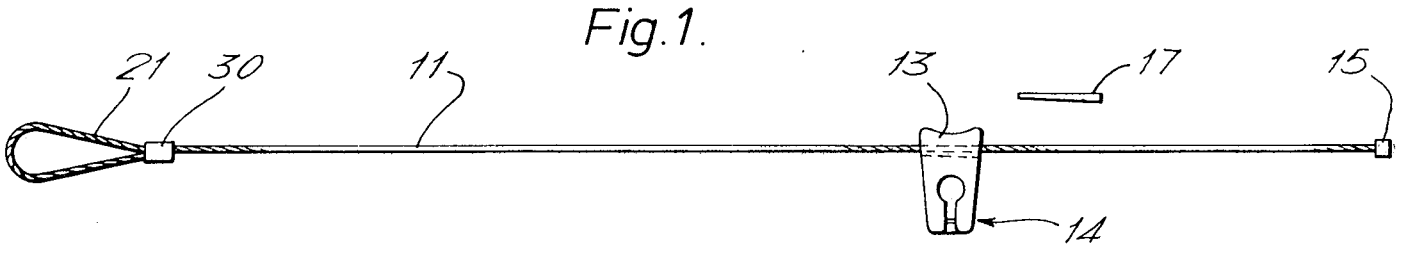
FIG. 1 is a front elevation of a wire-rope sling.
Figure 2:
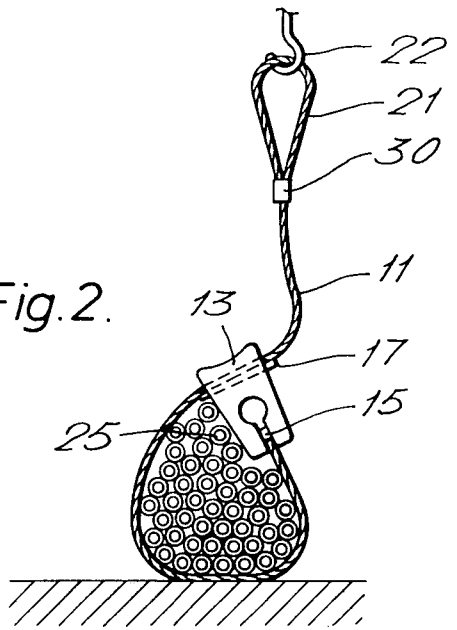
FIG. 2 is a view of the sling of FIG. 1 in use in lifting a bundle of pipes.
Figure 5:
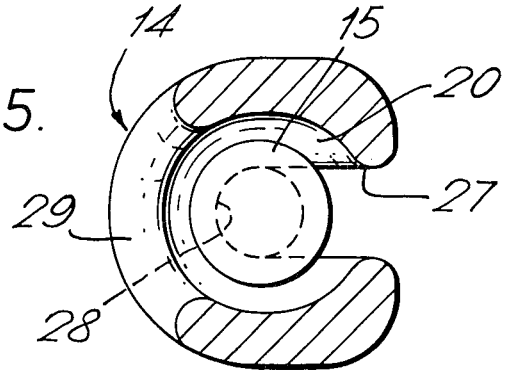
FIG. 5 is a sectional top plan view on the line V—V of FIG. 4.
Figure 6:
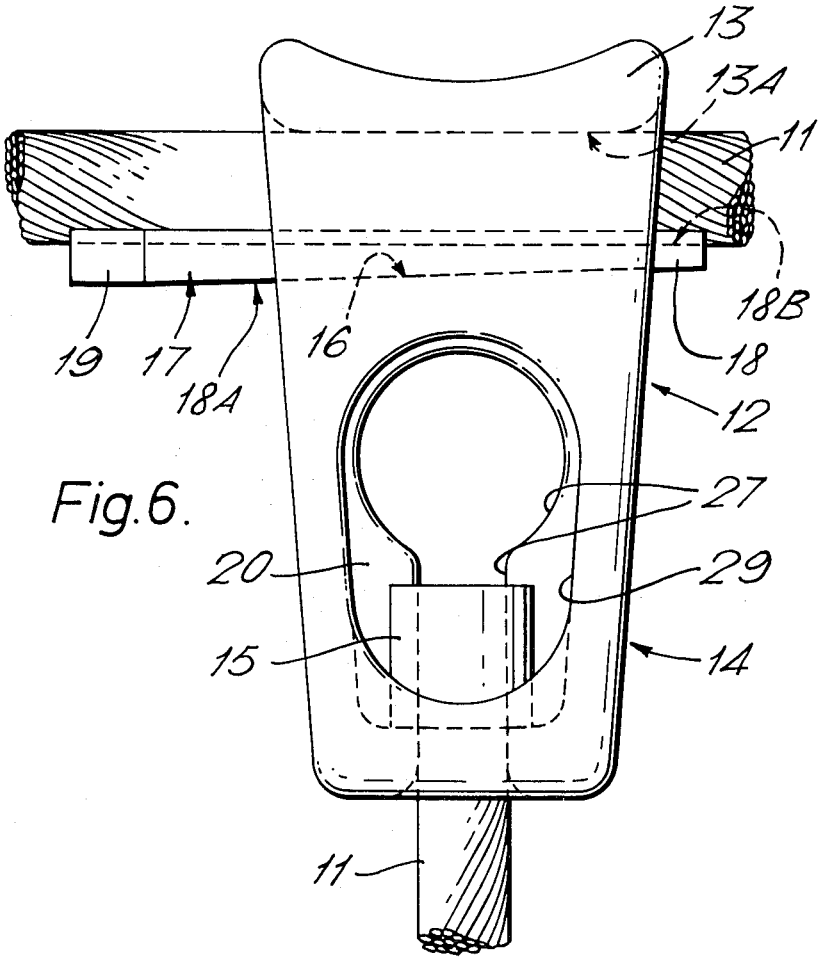
FIG. 6 is a rear view in the direction of the arrow VI in FIG. 4.

Referring to the drawings:

In FIGS. 1 to 6 a wire-rope sling includes a stretch of round-section wire rope 11; a choker device 12 which has an eye portion in the form of a sleeve 13 whereof a generally cylindrical bore 13A provides for free through-passage of the rope 11, and which has a coupling formation 14 formed as an integral lateral extension of the sleeve 13; a second coupling formation 15 at one end of the rope 11 detachably engageable with the coupling formation 14 of the choker device 12 to form a running noose of rope engaging around a bundle of pipes 25 forming the load; and a third coupling formation 21 at the other end of the rope 11 for detachable engagement with the lifting hook 22 of hoisting means which on lifting the load tighten the noose around the load.

The choker device 12 is in the form of a cast metal block which has chamfered corners and a slight taper from top to bottom. The top face of the block is convex from front to rear of the block; the bottom, end and front faces are flat; and the rear face is convex from end to end of the block. The sleeve 13 forms the upper part of the block, and the bore 13A of the sleeve extends from end to end of the sleeve and is of generally keyhole cross-section, that is comprises a part cylinder portion in which the rope is a sliding fit and a rectangular-section axial groove or channel 16 opening from the part-cylindrical portion and into which a rope length projects. The bottom of the groove 16 is wedged 1½° from end to end thereof, as indicated in FIG. 3.

The sling further includes a clamping pin 17 for insertion in the groove 16. The pin consists of a generally rectangular-section shank 18 which is a sliding fit in the groove 16 and has a wedge face 18A corresponding to the bottom of the groove 16, and a rectangular section head 19 extending laterally from the thick end of the shank 18 to facilitate driving of the pin 17 into the bore and extraction of the pin 17 from the bore. The face 18B opposite the wedge face of the pin's shank 18 is part-cylindrically recessed for mating engagement with a surface portion of the generally cylindrical rope 11. On driving (force-fitting) the pin 17 into the groove 16, the pin shank 18 slides wedgewise upwards and inwards into engagement with the rope 11 to clamp the rope 11 against the bore wall and so lock the rope 11 securely against running movement through the bore. By virtue of the recessed face 18B, maximum frictional effect is obtained, and wear of the rope 11 is reduced to a minimum. A tie member (not shown) is threaded through an opening in the head 19 of the pin 17 and engages around the rope 11 to retain the pin against loss.

The coupling formation 14 alongside the sleeve 13 has therein an upwardly extending cylindrical chamber 20 whereof the axis is at right angles to the axis of the sleeve. The walls of the chamber 20 have therein (a) an L-shaped slot 26 whereof the longitudinal opening 27 is in the front wall and is of keyhole shape and the lateral opening 28 is in the bottom wall of the chamber and extends radially to the centre of the bottom wall and (b) an elongate slot 29 in the rear wall and aligned with the circular portion of the opposed keyhole opening 27 in the front wall.

The complementary second coupling formation 15 on the rope 11 is a cylindrical ferrule secured to the rope end. The ferrule is removably insertible into the chamber 20 by manipulating same through the slots 27–29 to an upright co-axial position in the chamber 20, with the ferrule axis transverse to the axis of the sleeve, the end of the rope 11 being locked against removal from the chamber 20 when the rope 11 is under tension and being removable from the chamber 20 by manipulation through the slots when the rope 11 is slack.

The coupling formation 21 at the other end of the rope 11 is an eye engagement over the lifting hook 22 of the hoisting means e.g. a crane. The eye is formed by looping the end of the rope 11 back on itself, and then hand splicing it to the body of the rope 11 or securing it against the rope 11 at the neck of the loop by a mechanical clamp 30.

In use of the wire-rope sling, the rope 11 is passed round the bundle of pipes and the ferrule 15 is inserted into the chamber 20. The rope is tilted so that the ferrule turns through 90° and the rope extends through the opening 28. The eye 21 on the wire rope is attached to the lifting hook 22 of the crane.

The lifting hook is then raised, and as it rises the wire rope slides through the bore 13A until the pipes are in a tight bundle and any slackness in the wire rope has been taken up. At this point the clamping pin 17 is driven into the groove 16 to prevent further movement of the rope through the bore. The bundle of pipes is then lifted off the ground and transported to another location.

When the bundle of pipes reaches the other location the crane lowers the bundle to the ground and the eye 21 is detached from the hook 22. Since a portion of the wire rope is wedged in the bore of the choker device the wire rope is prevented from sliding through the bore and the pipes are therefore held tightly together.

Alternatively, the clamping pin 17 is not inserted into the bore until the bundle of pipes reaches the other location. That is, the bundle is lowered until it is just resting on the ground and the wire-rope is still tight around the bundle, at which point the clamping pin is driven into the bore to wedge the wire rope therein. The eye 21 may then be removed from the lifting hook 22 and the wire rope will not slide through the bore, so that the bundle stands freely on the ground.

To enable removal of the sling from the standing bundle of pipes, the eye 21 is attached to the hook 22, and the hook is raised to take up the load. Next, the clamping pin 17 is removed, and then the hook is lowered to release the load, the rope sliding freely through the bore of the choker device. It is noteworthy that the clamping pin 17 is removable only with difficulty unless the load is first taken up by the hook. Consequently, the operator is protected against the effects of sudden spillage of the load which would occur if the clamping pin 17 were removed without first taking up the load.

Figure 7:
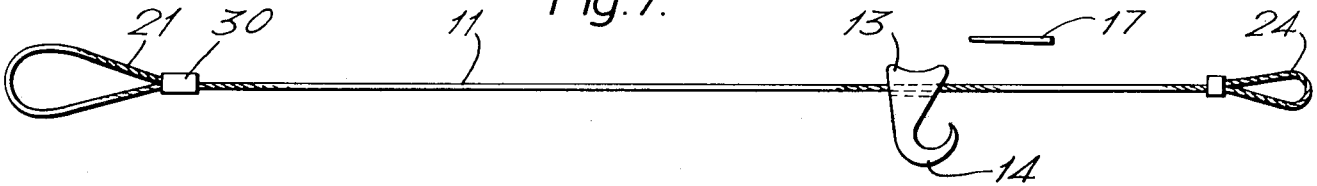
FIG. 7 is a front elevation of another form of sling.
Figure 8:
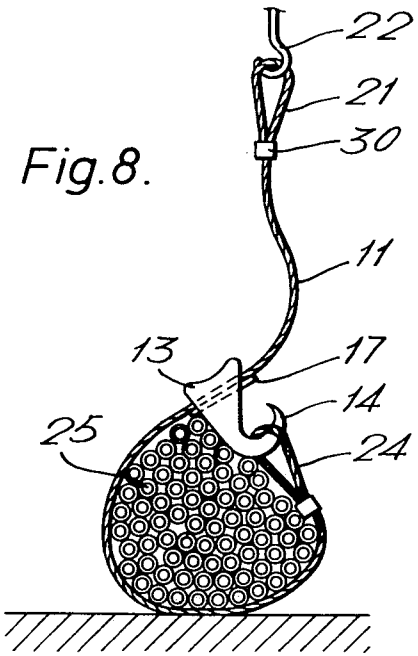
FIG. 8 is a view of the sling of FIG. 7 in use in lifting a bundle of pipes

In the embodiment shown in FIGS. 7 and 8, the portion 14 of the block is in the form of a hook which is engageable by an eye 24 formed on the rope 11 at an end thereof by a similar method to that described above for the eye 21 engageable with the lifting hook 22. The eye 24 is formed on the opposite end of the rope 11 from the eye 21 engageable with the lifting hook 22 of the crane. This arrangement is operated as described with reference to the previous embodiment, except that the eye 24 engages the hook 14.

In a modification, the channel of the bore is provided with an axial ridge, and the clamping pin is provided with a corresponding axial groove adapted to co-operate with the ridge in the channel to guide the pin into and from the channel.

Advantages of the wire-rope sling of the present invention as compared to previously-proposed slings are that the pipes do not spread out along the ground when the rope is detached from the lifting hook, and thus more bundles can be accommodated per unit area and bundles of pipes can be stacked one upon the other, to conserve the storage space. Moreover, in the embodiment described release of the bundles is effected instantly by simply knocking the clamping pin from the bore of the choker device; it is found that there is minimal damage to the wire rope on repeated insertion and removal of the clamping pin.

I claim:

1. A sling for use in lifting loads, comprising a wire rope, a choker having a sleeve through which the rope extends and having a first coupling formation adjacent to the sleeve, a second coupling formation on the rope at one end thereof and detachably engageable with the first coupling formation of the choker to form a tightenable noose of rope around the load, said sleeve having a generally keyhole-section bore whereof the wall is composed of a part-cylindrical portion in which the rope is a sliding fit so as to be locked against lateral displacement and a channel portion which opens from the part-cylindrical portion and into which a length of the rope projects laterally, and a pin which is a sliding fit in the channel portion and is insertible into the channel portion to clamp said length of the rope against the part-cylindrical portion of the bore wall and thereby prevent slackening of the noose tightened around the load.

2. A sling according to claim 1, wherein the pin comprises a shank having a longitudinal wedge face co-operable with a corresponding longitudinal wedge face of the channel portion so that sliding of the shank into the channel portion effects clamping of the rope length against the part-cylindrical portion of the bore wall.

3. A sling according to claim 2, wherein the channel portion and shank are of rectangular section, the bottom face of the channel portion being the wedge face thereof.

4. A sling according to claim 3, wherein the shank of the pin has a part-cylindrically recessed longitudinal face movable into mating engagement with the adjacent surface of the generally cylindrical rope length under the action of the co-operating wedge faces.

5. A sling according to claim 4, wherein the pin includes a head to facilitate striking of the pin on inserting same into the channel portion and facilitate withdrawal of the pin from the channel portion.

6. A sling according to claim 1, wherein the first coupling formation has a cylindrical chamber whereof the walls have slots therein, and the second coupling formation is a cylindrical head insertable through the slots and into the chamber to an operative position co-axial with the chamber.

7. A sling according to claim 6, wherein the rope has thereon at its other end a coupling formation co-operable with a coupling formation on hoisting gear to enable detachable connection of the sling to the hoisting gear.

* * * * *